United States Patent [19]

Steinbach

[11] 4,089,579

[45] May 16, 1978

[54] RIBBON CONNECTOR CONSTRUCTIONS

[75] Inventor: Thomas M. Steinbach, Park Ridge, Ill.

[73] Assignee: TRW Inc., Elk Grove Village, Ill.

[21] Appl. No.: 672,643

[22] Filed: Apr. 1, 1976

[51] Int. Cl.[2] ..... H01R 13/54

[52] U.S. Cl. ..... 339/91 R; 339/125 R

[58] Field of Search ..... 339/91 R, 125 R

[56] References Cited

U.S. PATENT DOCUMENTS

| | | | |
|---|---|---|---|
| 3,753,212 | 8/1973 | Yamada et al. | 339/91 R |
| 3,828,302 | 8/1974 | Cieniawa et al. | 339/91 R |

FOREIGN PATENT DOCUMENTS

| | | | |
|---|---|---|---|
| 2,215,221 | 10/1973 | Germany | 339/91 R |

*Primary Examiner*—Roy Lake
*Assistant Examiner*—E. F. Desmond
*Attorney, Agent, or Firm*—Neuman, Williams, Anderson & Olson

[57] ABSTRACT

A connector receptacle body has resilient latches in opposed end portions of the skirt-like body portion which extends between such latches. A connector plug body having a receptacle-receiving skirt portion is provided at opposed skirt ends with latch-receiving openings into which the receptacle latches may resiliently snap for purposes of interlocking said connector receptacle and plug into a connector assembly. In the course of disengaging the connector receptacle and plug, one or both latches are pushed inwardly and the receptacle and plug pulled apart. Metal contact mating portions encompassed by said connector skirts are urged into snug electrical engagement and said skirts telescopically engage when said connectors are in the interlocked condition.

14 Claims, 6 Drawing Figures

FIG. 1
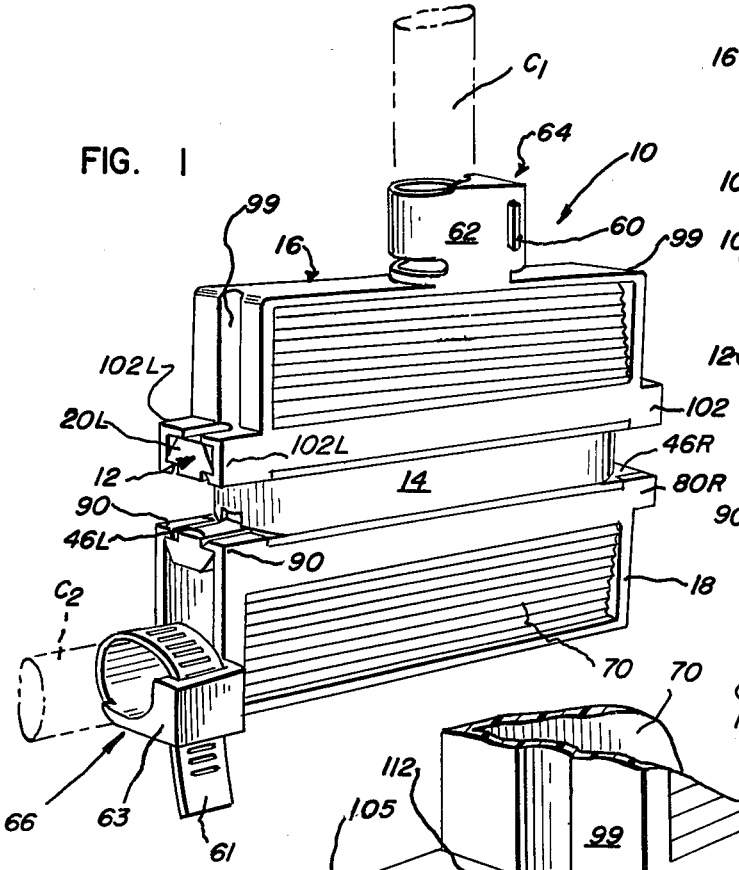
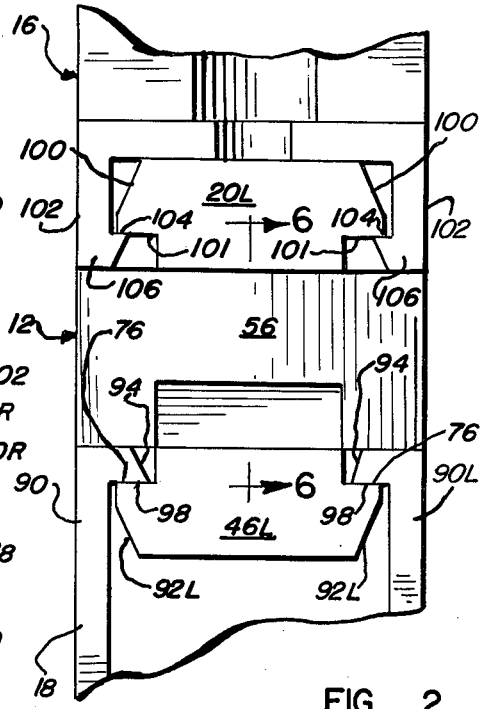
FIG. 2
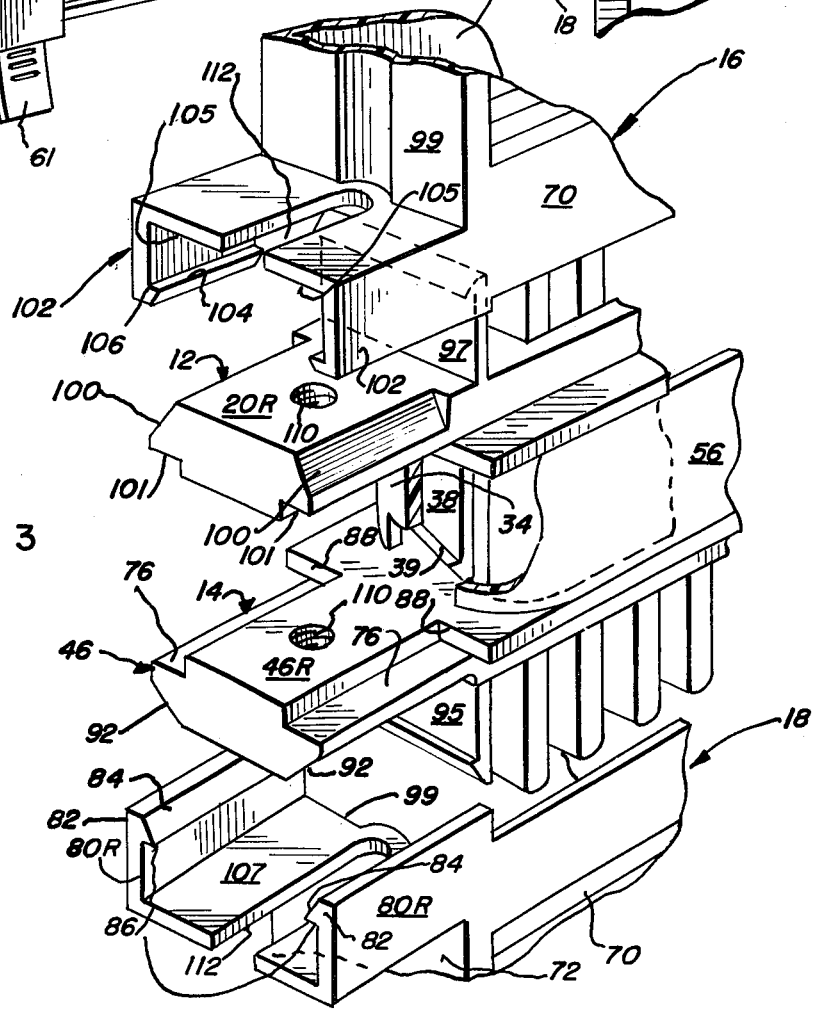
FIG. 3

RIBBON CONNECTOR CONSTRUCTIONS

This invention relates to a multiple contact ribbon-type termination system, and more particularly pertains to providing conveniently interlocking plug and receptacle connector constructions which may be formed entirely of plastic with the exception of metal contacts disposed therein.

A number of ribbon-type connector constructions and termination systems are known in the prior art. Included in the known connectors are those manufactured by TRW Inc. of Elk Grove Village, Il. and referred to as Cinch Ribbon connectors. Connectors of the type under consideration are employed in so-called miniature ribbon termination systems or high density systems in which a plurality of wires are terminated in closely adjacent relationship. The individual wires may be connected to individual contacts by various means; such as by soldering or by a solderless technique, e.g., such as is disclosed in McKee and Witte application Ser. No. 443,678, filed Feb. 19, 1974.

Ribbon connectors normally comprise a plastic body which receives and holds a number of wire-engaging contacts. The contacts are formed of an electrically conducting material such as a cadmium-bronze alloy. The contacts are designed to be connected to the wires at a termination end portion, and contact one another in mating pairs at the opposite or mating end to establish electrical continuity therebetween when two connectors are properly joined to one another. Separate rewiring devices such as screws have been used to secure the metal pairs together.

In solderless connectors the termination end portions of the contacts are formed with wire-gripping jaws not only to pierce the insulation covering a wire to effect electrical engagement with an insulation-covered wire, but in addition preferably are formed to prevent strain on the wire-contact joints when the wires are moved and thus prevent inadvertent wire-contact disengagements.

The connectors are made in receptacle (female) and plug (male) form adapted to form connector assemblies. The mating ends of the contacts in the plug are received against mating ends of the contacts of the receptacle to effect engagement whereby the wires connected to the contacts of the receptacle and plug are electrically connected. The contact mating end portions in some prior art connector constructions are surrounded by metal support shells which telecopically engage with one another in the course of the mating interfit. The metal shells provide a connector reinforcing function and in addition may be integrally formed with opposed apertured tab portions to facilitate locking of a connector assembly by receiving securing means as noted above, and/or to facilitate the mounting of the connectors on a supporting chassis or the like.

It is an object of this invention to provide connector assemblies of the noted type which may be secured together by the simple mating joinder of the two connectors.

It is another object of this invention to provide connector constructions of the type mentioned in which metal shells may be omitted with no deleterious consequences.

It is another object of this invention to provide all-plastic connector receptacle and plug bodies of novel design and having the metal contacts arranged in the usual manner for wire-connecting purposes and for mating with other connectors.

It is a further object of this invention to provide connector constructions in which novel, resilient latching means are provided and which also are adapted to mate with other connectors which do not have such latching means.

It is yet another object of this invention to provide integral plastic connector body constructions which may be molded in unitary form.

The above and other objects of this invention will become more apparent from the following detailed description when read in the light of the accompanying drawings and appended claims.

In one embodiment of the provided invention a plug connector is provided with a plastic body which receives a plurality of parallel aligned contacts arranged in two opposed series each in substantially the same plane. Each contact has a wire-teminating portion for purposes of effecting electrical engagement with a wire conductor. A contiguous mating portion of each contact extends from a central portion of the plug body, adjacent the central longitudinal axis of that body. A plastic skirt, integrally formed with the connector body of the plug, extends from the central body portion in encompassing relation with the mating portions of the contacts. Opeings are formed in opposed longitudinal end portions of the skirt. The openings are adapted to receive, in interlocking engagement, plastic resilient latch portions integrally formed with a connector receptacle body and disposed at opposed end portions of a skirt-like portion of that receptacle body. Such interlocking engagement occurs when the larger plug skirt receives said receptacle body skirt-like portion in a snug telescoping relation. The receptacle includes two spaced-apart series of aligned contacts having mating portions which are encompassed by the receptacle body skirt-like portion. The mating portions are spaced to receive said plug contact mating portions therebetween for purposes of effecting a snug contact-to-contact engagement. The connectors may be readily disengaged from their interlocking condition by urging a latch detent portion of a connector receptacle from locking engagement with the opening in the skirt of the connector plug as will hereinafter be described in greater detail. Also, plastic hoods may interlockingly engage each of the connectors as will also be described hereafter.

For more complete understanding of this invention reference will now be made to the drawings wherein:

FIG. 1 is a perspective view illustrating interlocking connector members employing teachings of this invention, with hood members detachably secured to each of the connectors;

FIG. 2 is a fragmentary end elevational view illustrating the nature of the hood-connector attachment means;

FIG. 3 is a fragmentary exploded view of the right end portions of the interlocked connector members of FIG. 1 showing their hood members in spaced relationship;

Figure 4:
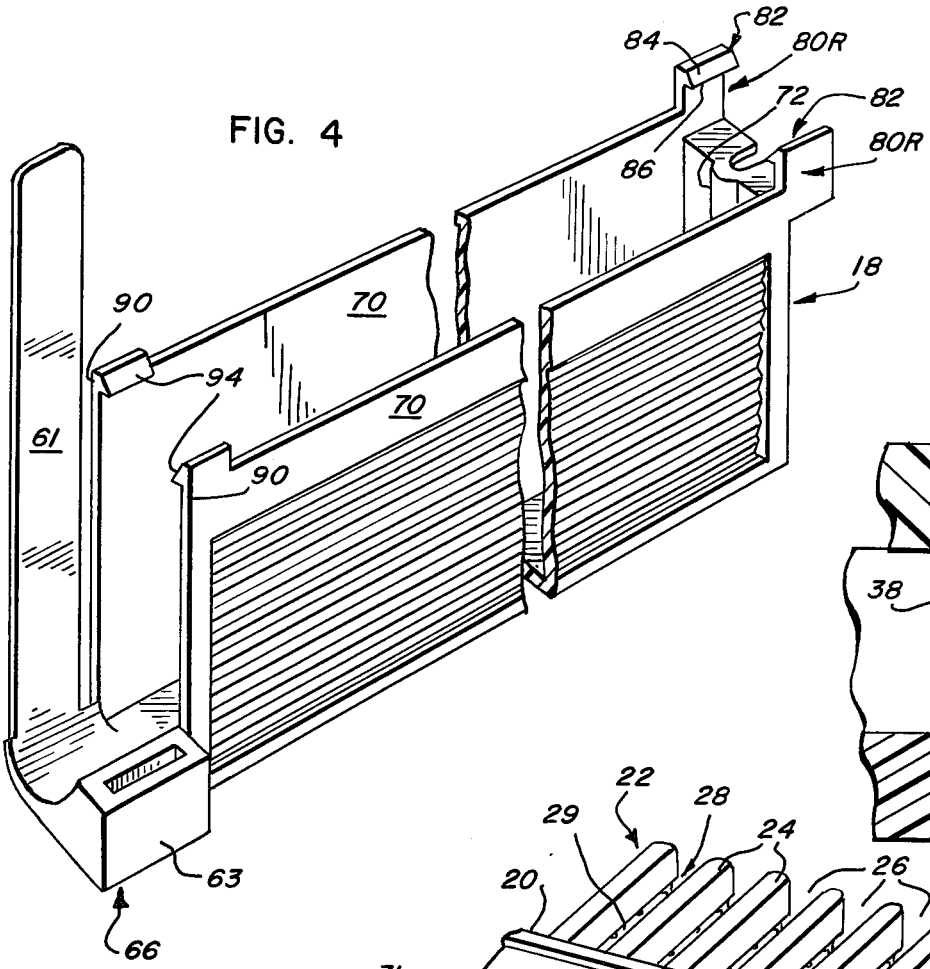
FIG. 4 is a perspective view of a hood member employed in the assembly of FIG. 1.

The connector-hood assembly 10 shown in FIG. 1 includes a receptacle or female connector 12 and a plug or male connector 14 connected to one another in mating relation, and a pair of hoods 16 and 18 attached to the respective connectors. It wll be noted that the connectors 12 and 14 illustrated are of the miniature ribbon type commonly employed in high density systems in which a plurality of wires are to be terminated in close relationship to one another. The structure of connector 12 is most clearly seen from FIG. 5 in which it will be be noted that it comprises an integral plastic body having a central body portion 20 integrally formed with a conductor-receiving portion 22. The condurcot-receiving portion has a plurality of parallel barrier members 24 extending from a central rib (not illustrated) which define therebetween wire-receiving channels 26. Thus portion 22 of the connector 12 has opposed series of channels 26 in which are disposed wire-engaging contacts 28 for purposes of engaging conductors such as insulation-covered wires to be terminated in such contacts.

The specific connector embodiments illustrated are of one solderless type. Howwver, the features of this invention, including the integral interconnecting elements and the hood mounting arrangement may be incorporated to equal advantage in connectors of the solderless type in which no channels are present, as well as in other connector construction well-known in the art such as the solder type.

Figure 5:
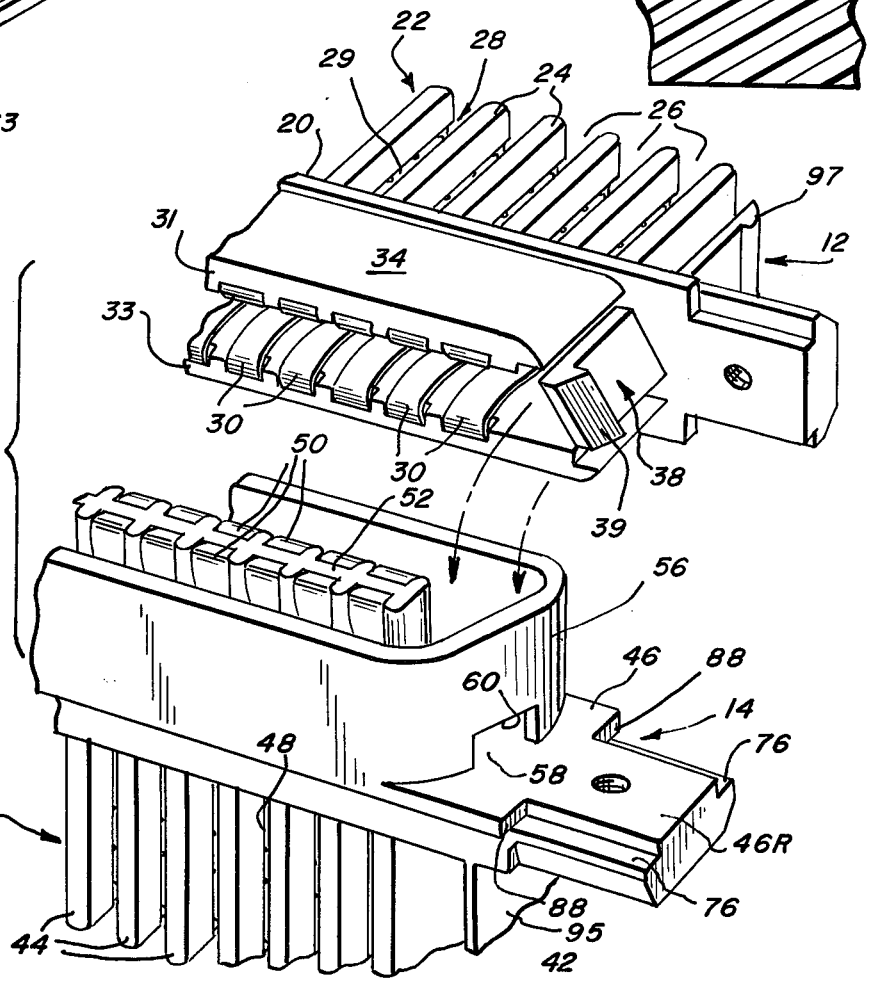
FIG. 5 is a fragmentary perspective view illustrating receptacle and plug connector members made in accordance with this invention prior to being interlocked in a connector assembly.

Contacts 28 include wire termination portions 29 which comprise wire gripping portions to establish electrical contact with the conductor core of a wire, and other portions which serve as a strain relief to assist in preventing removal of the wires from the contacts upon exertion of a force on such wires tending to remove the same from the channels in which disposed. Each contact, in addition to the wire termination portion 29 disposed in each channel 26, has integrally formed therewith a continuous mating portion 30 which extends through the connector portion 20 and extends on the opposite side thereof in a direction oppositely disposed to the conductor-receiving portion 22. A contact construction similar to that disclosed in FIG. 5 currently is in use in the Cinch Ribbon connectors of TRW Inc. noted above and is further described in McKee and Witte U.S. application Ser. No. 443,678, filed Feb. 19, 1974. It will be noted that the mating portions 30 of the opposed series of contacts 28 in the channels 26 extend from one side of the body portion 20 of connector 12, as illustrated in FIG. 5, so as to be arranged in two spaced apart aligned groups or series. These portions of the contacts are received and supported along opposed inner walls of side portions 31 and 33 of depending skirt-like body portion 34 in a known manner. Connector portion 34 is an element of the integral connector body 12 and the connector element in which the contact mating portions are received when effecting a connector assembly. Such skirt-like portions are well-known in the connector art. Each contact mating portion 30 typically is curved outwardly away from adjacent skirt wall 31 and 33, and has a hook portion at its terminal end which engages a slot at the other edge of the respective channel.

Disposed at opposed end portions of the receptacle connector body 34 are latch members 38, one of which is illustrated in FIG. 5 and in the exploded view of FIG. 3. The latch members 38 are resiliently and integrally formed with the body portion 20 of the connector 12 and have distal locking detent or shoulder portions 39 integrally formed therewith.

It is thus seen that the receptacle connector 12 of FIG. 5 comprises a conductor-receiving portion 22 extending from a central body portion 20 and oppositely disposed to skirt-like portion 34 in which mating portions of contacts 28 are aligned in opposed rows against spaced inner surfaces of the portion 34.

Also illustrated in FIG. 5 beneath the connector 12 is a plug connector 14 adapted to mate with connector 12 for purposes of effecting electrical connection between wires terminated in the contacts 28 of connector 12 and the wires terminated in contacts 48 of connector 14. The contacts 48 are disposed in channels 42 defined by a central longitudinal rib (not shown) and parallel lateral barrier elements 44 extending from a central biody portion 46 in a known manner. Contacts 48 have mating portions 50 which extend through the body portion 46 of the connector 14 and on the opposite side thereof in an opposite direction to the wire of conductor-receiving portions 49, in the same manner as the comparable components in the connector construction 12 above described. The contact mating portion 50 extend from the connector portion 46 adjacent the cenral longitudinal axis of such connector and are supported on a central insulator portion 52 comprising an integral portion of the connector body 14.

Figure 6:
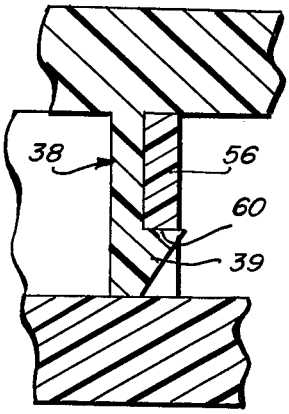
FIG. 6 is a fragmentary sectional view taken on line 6—6 of FIG. 2.

The contact mating portions 50 and the central insulating support 52 are centrally disposed of an encompassing skirt 56. The skirt 56 is integral with the body 14 and has openings 58 in opposed end portions. The relative dimensions of the connectors 12 and 14 are such that when the receptacle 12 and plug 14 are interconnected into a connector assembly, skirt-like body portion 34 of connector 12 is snugly received within the inner periphery of skirt 56 of connector 14. Simultaneously the resilient latches 38 are biased inwardly as the tapered detent portions 39 slide along the end portions of the skirt 56 overlying the openings 58. When skirt-like portion 34 is fully received within skirt 56, and the undersurface of portion 20 of connector 12 abuts the upper edge of skirt 56 of connector 14 as illustrated in FIG. 5, the locking detent portions 39 of latch members 38 will snap into place in the openings 58, thereby effecting an interlock with ledge 60 as is more clearly seen in the sectional view of FIG. 6.

Of course, as the connectors 12 and 14 are being so interconnected, the contact mating portions 50 of connector 14 slide between and engage the oppositely aligned contact mating portions 30 of connector 12 in the usual manner to effect electrical contact between each such pair of contacts and therefore between the wires connected to those contacts.

It is thus seen that by means of the above-described interlock constructions a connector receptacle and plug may be readily interlocked in mating engagement simply by telescoping the skirt of the receptacle connector within the skirt portion of the opposed plug connector until the latch shoulders 39 snap into locking enagement with the openings 58 formd in the plug connector skirt portion whereafter the two connectors are in a desired rigid state of assembly without the necessity for employing additional securing means.

FIG. 3 illustrates the connectors 12 and 14 in interlocing relationship, with a portion of the skirt 56 of the connector 14 broken away to show the disposition of the latch 38 in the normal position of connector assembly. To enable disengagement of the connector members 12 and 14 to be effected, one (or both) of the latch ends forming a shoulder 39 is uged inwardly toward the center of the connector 12 with which integrally formed until the shoulder 39 disengages from locking engagement with lodge 60 of the opening 58.

It will be noted from FIGS. 3 and 5 that the opposed portion of the skirt 56 in which the openings 58 are formed are not disposed in parallel relationship and are not disposed at right angles to the longitudinal side wall portions of the respective skirt. The two latches 38 are similarly oriented on connector 12. The resulting generally trapezoidal configuration assures proper polarization of connectors being joined, to insure the reception of the overlying skirt portion 34 and contact terminal portions therein in desired relationship relative to the contact terminal portions 50 disposed within skirt 56 of the plug contact 14. Thus proper interconnection is assured between the wires terminated in the contacts of the connector 12 and the wires terminated in the contacts of the connector 14.

Each of the connectors 12 and 14 may receive a protective hood which overlies the conductor-receiving portions of the connectors in the manner illustrated in FIG. 1. The illustrated hoods 16 and 18 are of integral plastic design. The structure of hoods 16 and 18 are the same with the exception of the location of the strain relief or cable clamp portions and the absence of an end wall adjacent strain relief 66 as is most clearly seen from FIGS. 1 and 4. Hood 16 has a cable clamp 64 comprising a flexible lock strap 60 which may secure a cable C, (illustrated in phantom lines in FIG. 1) to a slotted clamp bracket portion 62 by a one-way tooth engagement in the bracket. Clamp 64 and bracket portion 62 are integrally formed with the upper surface of hood 16. Hood 18 has a cable clamp 66 comprising an integral flexible lock strap 61 which may secure a cable such as cable C2 (also illustrated in phantom lines in FIG. 1) to a slotted clamp bracket portion 63 integrally formed with an end portion of the hood member 18. Flexible strap portion 61 of the clamp 66 is adapted to snugly engage the periphery of a cable which enters from the side of the hood and contains wires which are to be terminated in the channels of the connector 14 engaged therewith. Clamp 60 is similarly adapted to engage cable C1 entering the top of hood 16, and both clamps prevent axial forces exerted along the length of the cables from pulling the individual terminated wires within the connectors from engagement with the contacts therein.

It will be noted from FIG. 4 that hood 18 comprises opposed parallel wall portions 70 interconnected at one end by means of end wall 72. The side walls 70 are free to flex laterally relative to each other at their ends adjacent the cable clamp 66. The hood 18 is assembled to connector 14 by wedging right end portion 46R of chassis 46, illustrated in FIGS. 3 and 5, between spaced retention arms 80R of the hood 18 also clearly seen in FIG. 4, and simultaneously wedging left end portion 46L of the plug body between spaced hood retention arms 90, see FIG. 2, in the course of a simple "snap" action.

It will be noted that each hood retention arm 80R has integrally formed therewith at its end limit an inwardly disposed shoulder 82 having a beveled outer surface 84 and an underlying planar surface forming a shoulder 86. The opposed surfaces 86 abut opposed planar surfaces 76 formed on the connector portion 46R as seen in FIG. 5 when connector 14 and hood 18 are interlocked. In such condition the innermost edges of the retention arms 80 are adjacent shoulder 88 thereby functioning as one stop limiting slidable movement of the hood relative to the body surface 76. Since the structure of the right end portions of the connector and hood are similar to the left end portions as is obvious from the drawings, a similar abutment stop is present in the left portion of the assembly of FIG. 1.

In the course of the wedging action to effect a "snap" interlock, opposed downwardly beveled surfaces 92L on body portion 46L (see FIG. 2) engage bevel edge portions 94 illustrated in FIGS. 4 and 5 and are urged downwardly between the retention arms 90 which are integrally formed with the hood walls 70 and oppositely disposed to the retention arms 80. The downwardly-beveled surfaces 92L spread apart the upwardly beveled surfaces 94 of the retention arms 90, concomitantly spreading such arms 90 apart to enable the left portion of connector 14 to snap below planar surface portions 98 of the retention arms 90 as seen in FIG. 2. In such position surfaces 98 are in overlying engagement with opposed planar surfaces 76 of the connector body portion as is also illustrated in FIG. 2. Either a sliding interconnection or a similar wedging action is effected between the chassis portion 46R and arms 80R at the opposite end.

Resilient fingers 95 integrally formed with the body portion 46 of connector 14 (see FIGS. 3 and 5) are adapted to mount connector 14 on an apertured supporting panel or chassis (not illustrated) by means of a snap-in action in a manner similar to that disclosed in Kirby U.S. Pat. No. 3,824,552 of July 16, 1974. In the embodiment illustrated in the Kirby patent the mounting clips and connector body are discrete elements secured together. Connector 12 has resilient integral fingers 97 also seen in FIGS. 3 and 5 which function in the same manner as fingers 95.

Hood 16 is connected to connector 12 in the manner above described with respect to the connection between hood 18 and connector 14. The left portion 20L of body portion 20 of connector 14 snaps between resilient arms 102L as seen in FIG. 2 while simultaneously body portion 20R of connector 12 (FIG. 3) having upwardly beveled surface portions 100 wedge retention arms 102 of hood 16 apart until planar surface portions 104 of shoulders 106 snap in place beneath planar surfaces 101 of connector body portion 20R.

The intervals between surfaces 104 and over-lying planar portions 105 of hood 16 are preferably such as to snugly receive the thickness of the connector portion 20R therebetween. The intervals between shoulder surfaces 86 and planar surface portions 107 of hood 18 similarly are preferably such as to snugly receive the thickness of the connector body portion 46R therebetween. The relative dimensions of the correspondng left end portions of the assembly are similar.

The hoods 16 and 18 are readily disengaged from an engaged connector by merely spreading the hood retention arms disposed at either hood end sufficiently to allow disengagement of the connector from between the hood arms.

Apertures 110 in the connector body portions, and slots 112 in the hood end portions (FIG. 3) facilitate engagement with discrete securing means (not illustrated) which may be employed for additional securing purposes if desired when the illustrated elements are secured together or mounted on a support or the like (not illustrated).

It will be appreciated that latch openings may be provided in separately attached skirts which may be discrete connector elements formed of metal, and such skirts need not be integral with the connector body. Resilient latch fingers may be of design and materials other than those above described and similarly need not be integral with the connector bodies. Latch fingers and openings are located so as not to interfere with mating with connectors which do not have contemporary latching parts. Thus universal mating ability is retained while adding a single convenient latching arrangement.

It is also seen from the foregoing that integral plastic plug and receptacle connector bodies may be formed in plastic molding operations. The preferred embodiments of connector bodies above described have connecting means integrally formed therewith thereby dispensing with the need for discrete inerconnecting means and a separate assembly step. The connector members are readily latched to one another in an assembly as the contact mating portions of the two connectors are interfitted into electrical contact. The provided connector constructions may be molded of a plastic such as a polyester and may be formed without requiring an assembly step with metal securing parts; the provided connectors effect connector assemblies in a minimum amount of time and assembly costs. The provided connector constructions are also adapted to readily latch to protective hood members or the like by simple "snap" connections in the manner above described.

In view of the many modifications which may be made of this invention in light of the teachings above made, it is intended that the scope of this invention be limited only by the appended claims.

What is claimed is:

1. In a ribbon-type connector system the combination comprising:

a ribbon-type receptacle connector having a body of electrically insulating plastic and a plurality of wire engaging contacts fixedly mounted and aligned within said receptacle connector body and accessible to the connector exterior, each of said contacts having a wire termination portion for engaging a wire in electrical contact and a projecting ribbon-type contact mating portion integrally formed with said termination portion, said receptacle connector body having a centrally disposed body portion and a projecting, skirt-like structure with parallel wall portions extending from said centrally disposed body portion in a direction generally parallel to said contact mating portions, said contact mating portions being supportably mounted on opposed facing surfaces of said parallel wall portions;

a ribbon-type plug connector having a body of electrically insulating plastic and a plurality of wire engaging contacts fixedly disposed in said body and accessible to the connector exterior, each of said contacts of said plug connector having a wire termination portion for gripping a wire in electrical contact and a ribbon-type mating portion integrally formed with said termination portion, said plug plastic body including a substantially centrally disposed body portion, said contact termination and mating portions extending in opposite directions from said central body portion, said plug plastic body further having a projecting central support wall extending therefrom for securing the latter contact mating portions in outwardly facing parallel rows, and a skirt fixedly secured to said plug connector body and extending therefrom in encompassing relation with said contact mating portions of the plug, the outwardly facing contact mating portions of said plug connector being adapted to intermate with the opposed matng portions of said receptacle connector contacts in parallel mating rows upon interconnection of said plug and receptacle connector bodies, said plug connector skirt being adapted to encompass and interfit with said skirt-like structure of said receptacle connector; and resilient latch and cooperative receptacle means associated with said interfitting plug skirt and said receptacle skirt-like structure for securing said skirt and skirt-like support structure together in their mated relation and thereby securing said connectors in mated engagement against forces tending to separate said connectors.

2. In a ribbon-type connector system the combination according to claim 1 wherein said latch and latch-receiving means includes a plurality of latch-receiving openings disposed in said plug skirt and a plurality of resilient latch elements corresponding to each of said openings and being biased so as to normally engage said openings in holding said plug and receptacle connectors together.

3. In a ribbon-type connector system the combination according to claim 1 wherein said resilient latch and cooperative receptacle means includes at least one resilient, outwardly protruding latch along the skirt-like support structure of said receptacle connector and an inwardly open recess in said plug connector skirt, each latch being disposed at a location on the skirt-support structure opposite such an inwardly open recess so that it intermates in locking engagement with said recess when said plug and receptacle connectors are in mating engagement.

4. The combination of claim 3 in which said recess in said plug connector skirt extends through the thickness thereof whereby said latch is accessible through said recess from the exterior of said connectors when in mated engagement for disengagement from said plug skirt.

5. In a ribbon-type receptacle connector construction, the combination comprising an integral body of electrically insulating plastic having a centrally disposed body portion; a plurality of wire engaging contacts fixedly disposed in said body portion and accessible to the connector exterior; each of said contacts having a wire termination portion for engaging a wire in electrical contact, and a projecting ribbon-type contact mating portion integrally formed with the termination portion thereof; said connector having a projecting, skirt-like support structure with parallel wall portions extending from said centrally disposed body portion in a direction generally parallel to said contact mating portions; the mating portions of said contacts extending from said connector body being supportably mounted on opposed facing surfaces of said parallel wall portions, and latch means having projecting detent means disposed at spaced locations along said skirt-like support structure to facilitate the retention of said connector in mated relation with a cooperating connector.

6. The combination of claim 5 in which said latch means are interposed end portions of said parallel wall portions.

7. The combination of claim 5 in which said latch means are integrally formed with said receptacle connector body and are composed of electrically insulating plastic.

8. In a ribbon-type plug connector construction, the combination comprising a body of electrically insulating plastic; a plurality of wire engaging contacts fixedly disposed in said body and accessible to the connector exterior; each of said contacts having a wire termination portion for gripping a wire in electrical contact and a mating portion integrally formed with the termination portion thereof; said plastic body including a substantially centrally disposed portion; said contact termination portions and mating portions extending in opposite directions from said centrally disposed body portion; a connector skirt extending from said centrally disposed body portion in encompassing relation with said mating portions, said plastic body further including central contact support means extending from said connector centrally disposed body portion within said skirt periphery along substantially the central longitudinal axis of said connector; said mating portions of said contacts being supported by and extending over surface portions of said central support means; said contact mating portions being arranged in parallel opposed rows; and latch-receiving openings disposed in spaced portions of said skirt.

9. The plug connector of claim 8 in which said connector skirt comprises a discrete connector element formed of metal.

10. The combination of claim 8 in which said connector skirt is integrally formed with said plastic body and is formed of electrically insulating plastic.

11. The combination according to claim 8 wherein each of said latch-receiving openings includes a latch-receiving space recessed into the said skirt and opening on the interior of said connector, said opening further including a ledge surface defining a latch-retaining surface.

12. The combination according to claim 6 wherein said latch-receiving space extends through said skirt to define an aperture which provides access to the latching area from outside of the connector skirt while said plug connector is in its mated condition.

13. In a connector system the combination comprising a first connector body of electrically insulating plastic; a plurality of wire engaging contacts fixedly mounted in alignment therein; each of said contacts having a wire termination portion for effecting electrical contact with an engaged wire; each contact termination portion being integrally formed with a contact mating portion; resilient latch means having projecting detent portions, extending from said connector body in a direction generally parallel to said contact mating portions; parallel, projecting, connector wall portions supportably engaging said contact mating portions and supporting the same in two opposed parallel rows; each of said latch means being interposed end portions of said wall portions; a second connector body of electrically insulating plastic having a plurality of wire engaging contacts fixedly mounted in alignment therein; each of said contacts of said second connector body having a wire termination portion for effecting electrical contact with an engaged wire; each of the latter termination portions being integrally formed with a contact mating portion; the latter contact mating portions extending from said second connector body; said second connector having a skirt extending therefrom in a direction so as to encompass said mating portions of said contacts of said second connector; said skirt having spaced openings formed therein; said detents of said first connector latch means being interlockingly received in the openings of said skirt of said second connector when said connectors are joined with said mating portions of the contacts therein in contact with one another whereby said first and second connectors are maintained in tight abutting relation; said contacts of said second connector being simultaneously received between the parallel rows of the contacts of said first connector in a resilient interlock as said detents are received in said skirt openings; said first connector wall portions defining a skirt-like portion, and in combination with said latch means encompassing the mating portions of the contacts of said first connector; said skirt-like portion of said first connector being telescopically received within said skirt of said second connector when said latch detents of said first connector are received in the openings of said skirt of said second connector.

14. In a connector system the combination comprising a first connector body of electrically insulating plastic; a plurality of wire engaging contacts fixedly mounted in alignment therein; each of said contacts having a wire termination portion for effecting electrical contact with an engaged wire; each contact termination portion being integrally formed with a contact mating portion, resilient latch means having projecting detent portions, extending from said connector body in a direction generally parallel to said contact mating portions; parallel, projecting, connector wall portions supportably engaging said contact mating portions and supporting the same in two opposed parallel rows; each of said latch means being interposed end portions of said wall portions; a second connector body of electrically insulating plastic having a plurality of wire engaging contacts fixedly mounted in alignment therein; each of said contacts of said second connector body having a wire termination portion for effecting electrical contact with an engaged wire; each of the latter termination portions being integrally formed with a contact mating portion; the latter contact mating portions extending from said second connector body; said second connector having a skirt extending therefrom in a direction so as to encompass said mating portions of said contacts of said second connector; said skirt having spaced openings formed therein; said detents of said first connector latch means being interlockingly received in the openings of said skirt of said second connector when said connectors are joined with said mating portions of the contacts therein in contact with one another whereby said first and second connectors are maintained in tight abutting relation; said contacts of said second connector being simultaneously received between the parallel rows of the contacts of said first connector in a resilient interlock as said detents are received in said skirt openings; said first and second connectors having resilient mounting means with projecting shoulder portions for engaging peripheral edge portions of a mounting panel or the like; said resilient mounting means being disposed adjacent the opposed ends of the aligned contacts.

* * * * *

UNITED STATES PATENT AND TRADEMARK OFFICE

CERTIFICATE OF CORRECTION

PATENT NO. : 4,089,579

DATED : May 16, 1978

INVENTOR(S) : Thomas M. Steinbach

It is certified that error appears in the above-identified patent and that said Letters Patent are hereby corrected as shown below:

| | | |
|---|---|---|
| Column 1, | line 33, | "metal" should be -- mated -- |
| | line 55, | after "assembly" insert -- together -- |
| Column 2, | line 19, | "wire-teminating" should be -- wire-terminating -- |
| | line 27, | "Opeings" should be -- openings -- |
| Column 3, | line 13, | "condurcot" should be -- conductor -- |
| | line 23, | "Howwver" should be -- However -- |
| | line 28, | "construction" should be -- constructions -- |
| Column 4, | line 16, | "biody" should be -- body -- |
| | line 20, | "of" should be -- or -- |
| | line 23, | "portion" should be -- portions -- |
| | line 60, | "formd" should be -- formed -- |
| Column 5, | line 2, | "uged" should be -- urged -- |
| | line 5, | "lodge" should be -- ledge -- |
| | line 7, | "portion" should be -- portions -- |
| Column 6, | line 48, | "over-lying" should be -- overlying -- |
| | line 56, | "correspondng" should be -- corresponding -- |

UNITED STATES PATENT AND TRADEMARK OFFICE

CERTIFICATE OF CORRECTION

PATENT NO. : 4,089,579

DATED : May 16, 1978

INVENTOR(S) : Thomas M. Steinbach

It is certified that error appears in the above-identified patent and that said Letters Patent are hereby corrected as shown below:

| | | |
|---|---|---|
| Column 7, | line 5, | "design" should be -- designs -- |
| Column 8, | line 5, | "matng" should be -- mating -- |
| Column 9, | line 38, | "6" should be -- 11 -- |

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*